US008540098B2

(12) United States Patent
Langh

(10) Patent No.: US 8,540,098 B2
(45) Date of Patent: Sep. 24, 2013

(54) TRANSPORT FRAME

(75) Inventor: Hans Langh, Piikkio (FI)

(73) Assignee: Oy Langh Ship Ab, Piikkio (FI)

( * ) Notice: Subject to any disclaimer, the term of this patent is extended or adjusted under 35 U.S.C. 154(b) by 0 days.

(21) Appl. No.: 13/256,799

(22) PCT Filed: Mar. 17, 2010

(86) PCT No.: PCT/FI2010/050204

§ 371 (c)(1),
(2), (4) Date: Sep. 15, 2011

(87) PCT Pub. No.: WO2010/106229

PCT Pub. Date: Sep. 23, 2010

(65) Prior Publication Data

US 2012/0000906 A1 Jan. 5, 2012

(30) Foreign Application Priority Data

Mar. 18, 2009 (FI) ..... 20095280

(51) Int. Cl.
*B65D 88/12* (2006.01)

(52) U.S. Cl.
CPC ..... *B65D 88/129* (2013.01)
USPC ..... 220/1.5

(58) Field of Classification Search
CPC ..... B65D 88/129; B65D 88/12; B65D 88/02
USPC ..... 217/36; 220/647, 646, 639, 4.33
IPC ..... B65D 88/00, 88/12
See application file for complete search history.

(56) References Cited

U.S. PATENT DOCUMENTS

| | | | | | |
|---|---|---|---|---|---|
| 1,659,115 | A * | 2/1928 | McKay | 242/595 |
| 3,128,897 | A * | 4/1964 | Wilkins | 220/1.5 |
| 3,402,845 | A * | 9/1968 | Eriksson | 220/1.5 |
| 3,459,326 | A * | 8/1969 | Betjemann | 220/1.5 |
| 3,553,823 | A * | 1/1971 | Alfredsson | 228/170 |
| 4,805,794 | A * | 2/1989 | Tsuchiya et al. | 220/8 |
| 5,141,122 | A * | 8/1992 | Grogan | 220/1.5 |
| 5,570,981 | A * | 11/1996 | Brewster | 410/70 |
| 5,806,701 | A * | 9/1998 | Bae | 220/1.5 |
| 6,231,284 | B1 * | 5/2001 | Kordel | 410/49 |
| 2003/0019412 | A1 * | 1/2003 | Langh | 114/72 |

FOREIGN PATENT DOCUMENTS

| | | | |
|---|---|---|---|
| CN | 2343122 | Y | 10/1999 |
| DE | 71131 | A1 | 2/1970 |
| DE | 1952581 | A1 | 4/1971 |
| DE | 19 61 03 74 | A1 | 9/1996 |

(Continued)

OTHER PUBLICATIONS

International Search Report, dated Aug. 31, 2010, from corresponding PCT application.

(Continued)

*Primary Examiner* — Jacob K Ackun
*Assistant Examiner* — Robert J Hicks
(74) *Attorney, Agent, or Firm* — Young & Thompson

(57) ABSTRACT

A transport frame for transporting material and/or piece goods. At each bottom corner of the transport frame (1), a notch (6) is formed. The height (h) of the notch (6) is high enough to allow the bottom (7) of the transport frame (1), when the transport frame (1) is placed on top of transport protrusions (13) and/or locking clamps (14), to settle without bending against the mounting base (12) at least at some point.

20 Claims, 1 Drawing Sheet

(56) References Cited

FOREIGN PATENT DOCUMENTS

| | | | |
|---|---|---|---|
| FI | 120232 | B1 | 8/2009 |
| JP | 60099292 | U | 7/1985 |
| WO | 2008/142202 | A2 | 11/2008 |

OTHER PUBLICATIONS

Chinese Office Action, dated Apr. 9, 2013, from corresponding CN application.

* cited by examiner

TRANSPORT FRAME

BACKGROUND OF THE INVENTION

The invention relates to a transport frame for transporting material and/or piece goods.

Typically the transport frames, such as containers, used in sea transports are supported and fastened to the transport base at their corners. Thus, the weight of the transport frame is directed to certain point-form locations in the transport base. In addition, high loads are directed to the locking arrangement of the frame at high seas, for instance.

Publication WO 2008/142202 discloses a solution, in which the bottom structure of a transport frame comprises a flexible support surface for supporting the frame against a deck in the cargo space of a ship, whereby the rigidity of the frame is dimensioned in such a manner that the bottom structure of the frame is arranged to flex elastically to an extent that allows the bottom structure of the frame to bend against the deck and the flexible support surface to form a pressure equalisation surface against the deck when the frame is loaded with reels. This way, the weight of the frame and its cargo can be distributed in such a manner that it also loads the deck at other locations than just the fastening points. The pressure equalisation surface that is in contact with the ship's deck also acts as a friction surface, thus reducing the loads directed to the locking arrangement of the frame. However, the solution requires that the bottom structure be arranged flexible and that the load of the frame is arranged at correct locations and suitable in size so that the frame bends in the required manner.

BRIEF DESCRIPTION OF THE INVENTION

It is an object of the invention to provide a novel transport frame.

The transport frame of the invention is characterised in that at each bottom corner of the transport frame a high enough notch is formed that when the transport frame is placed on top of transport protrusions and/or locking clamps, the bottom of the transport frame settles without bending against the surface of the mounting base at least at some location.

The idea of the invention is that at each bottom corner of the transport frame a high enough notch is formed that when the frame is placed on top of transport protrusions and/or locking clamps, the bottom of the transport frame settles without bending against the mounting base at least at some location. The load caused by the transport frame and the transported goods or material loaded thereon is then partially also distributed against the mounting base and not only to the corners and/or other fastening points of the transport frame. The loads directed to the corners and/or fastening points of the transport frame can then be reduced and heavier cargo than before can be placed in the transport frame. The structure of the transport frame is on the whole simple and the solution is reliable.

BRIEF DESCRIPTION OF FIGURES

Some embodiments of the invention are described in greater detail in the attached drawings, in which.

In the figures, some embodiments of the invention are shown simplified for the sake of clarity. Similar parts are marked with the same reference numbers in the figures.

DETAILED DESCRIPTION OF THE INVENTION

Figure 1:
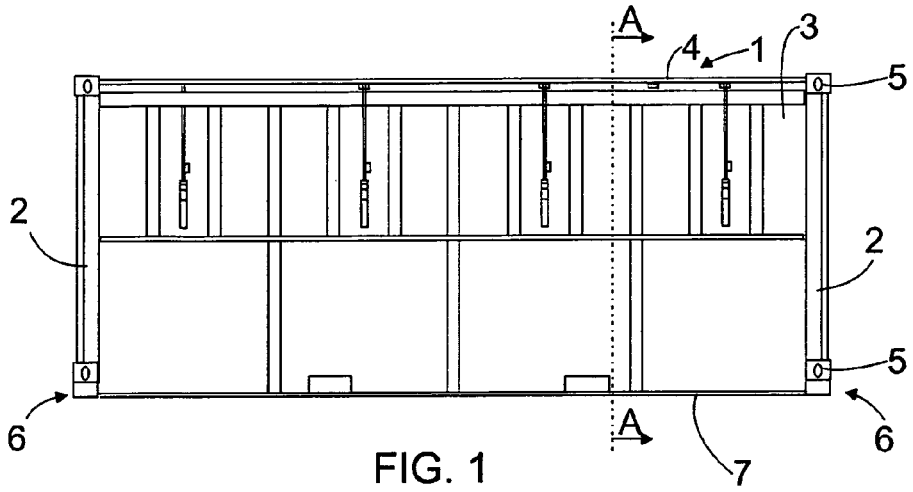
FIG. 1 is a schematic side view of a transport container.
Figure 2:
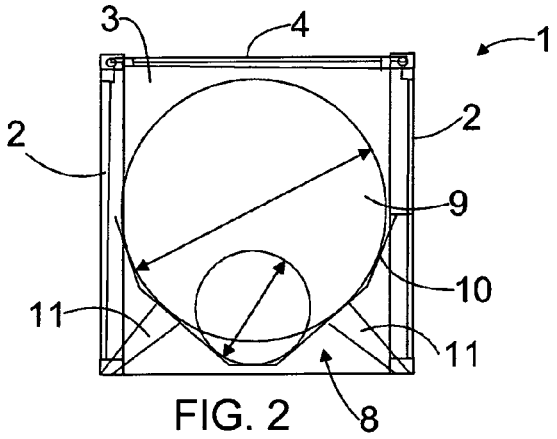
FIG. 2 is a schematic view of the transport container of FIG. 1 cut along line A-A of FIG. 1.

FIGS. 1 and 2 show a transport container having the dimensions of a standard 20-foot container. The length of the transport container 1 is thus 20 feet, that is, approximately 6.1 m. The width of the transport container 1 is 8 feet, that is, approximately 2.4 m, and the height of the transport container 1 is approximately 2.59 m. The presented solution may naturally also be applied to transport frames of other sizes, such as to 10-, 30-, 40-, 45-, or 53-foot transport containers or frames.

There are corner poles 2 at the corners of the transport container 1. Further, the transport container 1 is furnished with walls 3 and roof 4. The roof 4 is preferably detachable. One or more doors may be arranged to the walls 3.

A corner casting 5 is arranged to the top and bottom ends of the corner poles 2. Thus, the transport container 1 may be fastened to a mounting base. The mounting base may be a ship's tween-deck or the bottom of the cargo space of a ship or the cargo deck of a ship. Thus, the transport frame is then arranged for use in sea tranports. Further, the mounting base may be a pallet or deck or a corresponding mounting base of another transport means, such as train or truck. The fastening arrangement has a locking clamp that may be a twist lock, for example. Further, it is also possible to fasten superposed transport containers 1 to each other by means of the fastening arrangement described above.

The corner castings 5 at the bottom ends of the corner poles 2 are arranged higher than the bottom 7 of the transport container 1 in such a manner that the bottom ends of the corner poles have notches 6. The notch 6 is high enough to accommodate a locking clamp, for example, below the corner casting 5 of the bottom end of the corner pole 2 in such a manner that the bottom 7 of the transport frame 1 touches the mounting base so that the bottom of the transport frame 1 does not need to bend.

As shown in FIG. 2, the transport container 1 comprises a trough 8 for reels 9. Therefore, the transport container may be called a transport frame for transporting reels. In this context, reels refer especially to heavy steel reels that are formed of coiled steel plates. Further, the reels may be any structurally cylindrical pieces, such as paper reels. The weight of a reel is typically 10 to 25 tons, but it may be even heavier than this.

The trough 8 forms a cradle for the reels 9 and forms a uniform surface that extends along the length of the transport container 1. The side walls 10 of the trough 8 form support surfaces that provide lateral support for the reels 9. The side walls 10 of the trough are designed to provide optimum support for reels of different sizes, which the circles of various sizes drawn in the figure illustrate. The diameter of the largest circle is approximately 2100 mm and that of the smallest is approximately 900 mm. The side walls 10 of the trough are initially at an approximately 100° angle to each other and finally at an approximately 40° angle to each other. The degrees may also differ from these and they may be defined according to the shape and size of the reel. The shape and height of the side walls 10 of the trough are arranged such that the reel 9 remains in the cradle even without fastening lines.

Two longitudinal supports below the trough 8 are marked with reference number 11 in FIG. 2. The longitudinal supports 11 extend from one end of the transport container 1 to the other. The weight caused by the reels 9 is transmitted from the longitudinal supports 11 to the bottom structure of the transport container 1. There may also be transverse supports below the trough 8. The trough 8 may be closed at the bottom and the side walls 10 may also be closed. This way, the transport container may be utilised to transport not only reels 9 but also bulk goods and material.

Figure 3:
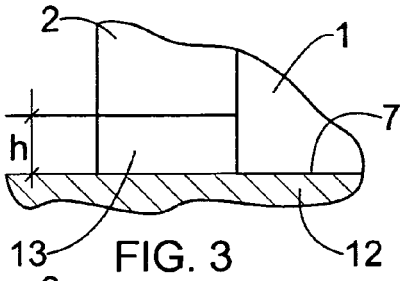
FIG. 3 is a schematic view of a bottom corner of a transport frame.

FIG. 3 shows a solution, in which the transport frame 1 is arranged on a mounting base 12 in such a manner that the corners of the transport frame 1 are placed at the transport protrusions 13 on top of the mounting base 12. The transport protrusions 13 are thus fixedly connected to the mounting base 12. The height h of the notch 6 in the corner of the transport frame 1 corresponds to the height of the transport protrusion 13. Thus, the corner pole 2 rests on the transport protrusion 13 and the bottom 7 of the transport container 1 is against the surface of the mounting base 12. In this case the transport container 1 has not been fastened to the transport protrusion but the transport frame 1 supports against the transport protrusions 13 in the lateral direction and remains in place under gravity.

Figure 4:
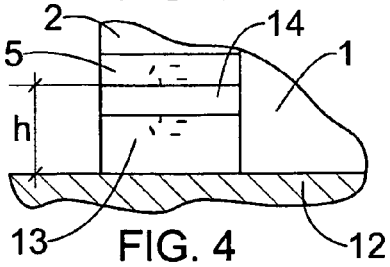
FIG. 4 is a schematic view of a bottom corner of another transport frame.

FIG. 4 shows an embodiment in which the bottom part of the corner of the transport frame 1 is equipped with a corner casting 5. Further, the transport frame is locked to the transport protrusion 13 with a locking clamp 14, such as twist lock. Thus, the height h of the notch 6 corresponds to the combined height of the transport protrusion 13 and locking clamp 14.

Figure 5:
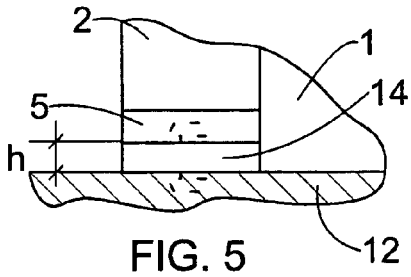
FIG. 5 is a schematic view of a bottom corner of a third transport frame.

FIG. 5 shows an embodiment in which the bottom corner of the transport frame 1 is also equipped with a corner casting 5 and the transport frame is locked to the mounting base 12 with locking clamps 14. However, there are no transport protrusions on top of the mounting base 12, whereby the height h of the notch 6 in the corner corresponds to the height of the locking clamp 14.

The present solution is also suitable for use with other transport frames than those intended for transporting reels. The transport frame may be a container or one differing from the container structure.

The present solution allows a higher load on the mounting frame than when it is loaded through just the fastening points of the transport frame. According to an example, a cargo deck may be loaded by 102 tons through the fastening points of a 40-foot transport frame. Instead, the same deck may be loaded by utilising its surface, that is, by distributing weight evenly on a certain area at 15 tons/$m^2$. In such a case, it is possible to load the surface area required by a 40-foot transport frame by approximately 430 tons. With the present solution, the weight of the cargo may be directed partly or even entirely against the mounting base instead of the fastening points, and thus the mounting base may be loaded more than before.

In some cases, the features disclosed in this patent application may be used as such, regardless of other features. On the other hand, the features disclosed in this patent application may, when necessary, be combined to form various combinations.

The drawings and the related description are only intended to illustrate the idea of the invention. The invention may vary in detail within the scope of the claims.

The bottom structure and/or the frame structure contacting the mounting base 12 of the transport frame 1 may be made flexible. The bottom structure may then touch an uneven mounting base 12 at some point, when the transport frame is empty, and bend to touch the mounting base at several points and/or over a wider area, when the transport frame 1 is loaded with reels or other goods.

The invention claimed is:

1. A transport frame for transporting at least one of material and piece goods, the transport frame defining bottom corners, wherein at each bottom corner of the transport frame, a notch is formed having a height that allows a bottom of the transport frame, when the transport frame is placed on top of at least one of transport protrusions and locking clamps, to settle without bending against a surface of a mounting base;

wherein for each notch of the transport frame, a corner casting is arranged, whereby the transport frame is fastenable to the mounting base with a locking clamp.

2. The transport frame as claimed in claim 1, wherein the transport frame is a transport container.

3. The transport frame as claimed in claim 1, further comprising:

a trough defining a cradle to receive and laterally support at least one cylindrical reel; and a support frame supporting the trough.

4. The transport frame as claimed in claim 3, wherein the trough extends along a longitudinal direction of the transport frame from a first end of the transport frame to a second end of the transport frame.

5. The transport frame as claimed in claim 1, wherein the transport frame is a sea transport container.

6. A transport frame for transporting cargo in combination with a mounting base, wherein, the mounting base comprises a plurality of mounting extensions, each mounting extension including at least one of a transport protrusion and a locking clamp, each one of the transport protrusion and the locking clamp having a first height; and said transport frame comprises:

a bottom section having a substantially rectangular shape, the bottom section defining four elongated sides;

four walls, each of the four walls extending from a different one of the four elongated sides in a first direction substantially perpendicular to the bottom section, the four walls defining four corner edges extending in the first direction;

a corner pole disposed along each of the four corner edges; and a corner casting disposed at a bottom of each corner pole, a bottom surface of each corner casting being upwardly displaced from a bottom surface of the bottom section by the first height to form a notch located immediately below each corner casting;

wherein the transport frame mounts on the mounting base with each of the notches mated with a corresponding one of the transport protrusion and the locking clamp; and wherein with the notches mated with the corresponding one of the transport protrusion and the locking clamp, (i) the bottom surface of each corner casting lies flush against a top surface of the corresponding one of the transport protrusion and the locking clamp, and (ii) the bottom surface of the bottom section lies flush against a top surface of the mounting base, the bottom section being unbent.

7. The transport frame in combination with the mounting base as claimed in claim 6, wherein the transport frame is a sea transport container.

8. The transport frame in combination with the mounting base as claimed in claim 7, further comprising:

a trough constructed and arranged to receive at least one reel; and a support frame supporting the trough, the trough and support frame being constructed and arranged supporting the at least one reel in a lateral direction of the transport frame.

9. The transport frame in combination with the mounting base as claimed in claim 8, wherein the trough extends in a longitudinal direction of the transport frame, the lateral direction being substantially perpendicular to the longitudinal direction, the trough extending from a first end of the transport frame to a second end of the transport frame.

10. The transport frame in combination with the mounting base as claimed in claim 6, further comprising:

a trough constructed and arranged to receive at least one reel; and a support frame supporting the trough, the trough and support frame being constructed and arranged supporting the at least one reel in a lateral direction of the transport frame.

11. The transport frame in combination with the mounting base as claimed in claim 10, wherein the trough extends in a longitudinal direction of the transport frame, the lateral direction being substantially perpendicular to the longitudinal direction, the trough extending from a first end of the transport frame to a second end of the transport frame.

12. The transport frame in combination with the mounting base as claimed in claim 6, wherein the transport frame is a sea transport container.

13. The transport frame in combination with the mounting base as claimed in claim 6, wherein, each mounting extension includes one of the transport protrusion and the locking clamp, and each corner casting is constructed and arranged to fasten via the locking clamp to the transport protrusion of the corresponding one mounting extension.

14. The transport frame as claimed in claim 1, wherein, each corner casting is disposed immediately above the corresponding notch formed at each bottom corner of the transport frame, and said height of each notch equals a distance of a lower surface of each corner casting above the bottom of the transport frame.

15. The transport frame as claimed in claim 13, in combination with the four of said at least one transport protrusion, and the locking clamps, wherein, a height of each transport protrusion equals the height of each corresponding notch.

16. A transport frame for transporting cargo, and for mating with a mounting base comprising a plurality of mounting extensions, each mounting extension having a first height, said transport frame comprising:

a bottom section having a substantially rectangular shape, the bottom section defining four elongated sides;

four walls, each of the four walls extending from a different one of the four elongated sides in a first direction substantially perpendicular to the bottom section, the four walls defining four corner edges extending in the first direction;

a corner pole disposed along each of the four corner edges; and a corner casting disposed at a bottom of each corner pole, a bottom surface of each corner casting being upwardly displaced from a bottom surface of the bottom section by the first height to form a notch located immediately below each corner casting, wherein, when mated with the mounting base, i) each of the notches mate with a corresponding one of the mounting extensions, and ii) the bottom surface of each corner casting lies flush against a top surface of the corresponding one mounting extension, and the bottom surface of the bottom section lies flush against a top surface of the mounting base, the bottom section being unbent.

17. The transport frame as claimed in claim 16, in combination with the mounting base, wherein, each mounting extension includes a transport protrusion with a locking clamp, and each corner casting is constructed and arranged to fasten with the locking clamp to the transport protrusion of the corresponding mounting extension.

18. The transport frame as claimed in claim 17 in combination with the mounting base, the transport frame further comprising:

a trough defining a cradle to receive and laterally support at least one cylindrical reel; and a support frame supporting the trough.

19. The transport frame as claimed in claim 18 in combination with the mounting base, wherein the trough extends along a longitudinal direction of the transport frame from a first end of the transport frame to the a second end of the transport frame.

20. The transport frame as claimed in claim 17 in combination with the mounting base, wherein the transport frame is a sea transport container.

* * * * *